US009933798B2

(12) United States Patent
Isobe

(10) Patent No.: US 9,933,798 B2
(45) Date of Patent: Apr. 3, 2018

(54) VOLTAGE REGULATOR

(71) Applicant: SII Semiconductor Corporation, Chiba-shi, Chiba (JP)

(72) Inventor: Yoshihisa Isobe, Kumamoto (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 0 days.

(21) Appl. No.: 15/403,885

(22) Filed: Jan. 11, 2017

(65) Prior Publication Data

US 2017/0205842 A1 Jul. 20, 2017

(30) Foreign Application Priority Data

Jan. 15, 2016 (JP) ..... 2016-006486

(51) Int. Cl.

| | |
|---|---|
| ***G05F 1/565*** | (2006.01) |
| ***G05F 1/46*** | (2006.01) |
| ***G05F 1/56*** | (2006.01) |
| *G05F 3/22* | (2006.01) |
| *G05F 1/575* | (2006.01) |

(52) U.S. Cl.

CPC ..... *G05F 1/565* (2013.01); *G05F 1/468* (2013.01); *G05F 1/561* (2013.01); *G05F 1/575* (2013.01); *G05F 3/22* (2013.01)

(58) Field of Classification Search

CPC . G05F 1/75; G05F 1/561; G05F 1/565; G05F 1/468; G05F 3/22

See application file for complete search history.

(56) References Cited

U.S. PATENT DOCUMENTS

| | | | | |
|---|---|---|---|---|
| 7,199,566 | B2 | 4/2007 | Suzuki | |
| 8,054,055 | B2 * | 11/2011 | Mandal | G05F 1/565 323/280 |
| 8,810,219 | B2 * | 8/2014 | Suzuki | G05F 1/575 323/274 |
| 2013/0113447 | A1 * | 5/2013 | Kadanka | G05F 1/56 323/280 |
| 2014/0354249 | A1 * | 12/2014 | Kurozo | G05F 1/575 323/271 |

FOREIGN PATENT DOCUMENTS

| | | |
|---|---|---|
| JP | 2006-018774 | 1/2006 |

* cited by examiner

*Primary Examiner* — Kyle J Moody
(74) *Attorney, Agent, or Firm* — Brinks Gilson & Lione

(57) ABSTRACT

Provided is a voltage regulator configured to stably operate with low current consumption, and having good responsiveness. A delay circuit is provided between a transient response improvement circuit and a voltage amplifier circuit.

1 Claim, 4 Drawing Sheets

VOLTAGE REGULATOR

RELATED APPLICATIONS

This application claims priority under 35 U.S.C. § 119 to Japanese Patent Application No. 2016-006486 filed on Jan. 15, 2016, the entire content of which is hereby incorporated by reference.

BACKGROUND OF THE INVENTION

1. Field of the Invention

The present invention relates to a voltage regulator configured to operate with low current consumption, and having good responsiveness.

The present application claims priority based on Japanese Patent Application No. 2016-006486 filed in Japan on Jan. 15, 2016, the disclosures of which are incorporated herein by reference in their entirety.

2. Description of the Related Art

Voltage regulators are provided in electronic devices such as cellular phones, which are configured to operate with rechargeable batteries, such that the electronic devices stably operate even when a charged state of the batteries fluctuates. Further, the voltage regulator, which is configured to prevent an output voltage from fluctuating such that the electronic device stably operates even when a load sharply fluctuates, is provided with a control circuit for achieving a more stable output voltage of the voltage regulator in some cases.

FIG. 3 is a circuit diagram of a related-art voltage regulator 30. A reference voltage circuit 31 is configured to output a reference voltage Vref. From a resistor 32 and a resistor 33, a feedback voltage VFB obtained by dividing an output voltage Vout at an output terminal by the resistors is output. A voltage amplifier circuit 34 is configured to control a PMOS transistor 35 based on a result of comparison between the reference voltage Vref and the feedback voltage VFB such that the output voltage Vout is constant. A transient response improvement circuit 36 is configured to receive the reference voltage Vref and a power supply voltage as input to control an operating current of the voltage amplifier circuit 34.

The transient response improvement circuit 36 includes a detection portion configured to detect fluctuation in power supply voltage, and an output portion, and is configured to detect fluctuation in power supply voltage and to control an operating current that is to flow through the voltage amplifier circuit 34. With increase in current of the voltage amplifier circuit 34 depending on the detected power supply voltage level, the transient response characteristics of the voltage amplifier circuit 34 are improved.

FIG. 4 is a circuit diagram of the transient response improvement circuit and the voltage amplifier circuit according to the related art. The transient response improvement circuit 36 includes a constant current portion including PMOS transistors 1 and 2, a detection portion including NMOS transistors 3 and 4 and a capacitor 6 and being configured to detect fluctuation in power supply voltage, and an output portion including an NMOS transistor 5.

The transient response improvement circuit 36 is configured to detect fluctuation in power supply voltage to control a current that is to flow through the voltage amplifier circuit 34. The operating current of the voltage amplifier circuit 34 is increased depending on a decreasing level of the detected power supply voltage, that is, the transient response of the voltage amplifier circuit 34 is improved (for example, see Japanese Patent Application Laid-open No. 2006-18774).

However, in the transient response improvement circuit described above, after fluctuation in power supply voltage is detected and the operating current of the voltage amplifier circuit is increased, timing at which the operating current of the voltage amplifier circuit is returned to a normal value cannot be arbitrarily set. Thus, there is a drawback that the operating current of the voltage amplifier circuit is returned to the normal value during transient response, and optimal transient response characteristics cannot be obtained.

In addition, the transient response improvement circuit described above has a drawback that the operating current of the voltage amplifier circuit is excessively increased and the voltage amplifier circuit does not stably operate, when a voltage decreasing level of a detected power supply voltage is large.

SUMMARY OF THE INVENTION

The present invention has been made in order to solve the problems described above, and achieves a voltage regulator having optimal transient response characteristics.

In order to solve the related-art problems, a voltage regulator according to one embodiment of the present invention has the following configuration.

The voltage regulator includes:

a voltage amplifier circuit configured to compare a feedback voltage depending on an output voltage of an output transistor and a reference voltage to each other to control the output transistor;

a transient response improvement circuit configured to detect fluctuation in one of a power supply voltage and the output voltage; and a delay circuit connected to an output terminal of the transient response improvement circuit, in which an operating current of the voltage amplifier circuit is controlled depending on a signal that is output from the transient response improvement circuit.

According to the voltage regulator of the present invention, the delay circuit is provided between the transient response improvement circuit and the voltage amplifier circuit, and hence there is an effect that the transient response characteristics of the voltage amplifier circuit can be optimized.

DETAILED DESCRIPTION OF THE PREFERRED EMBODIMENTS

Figure 1:
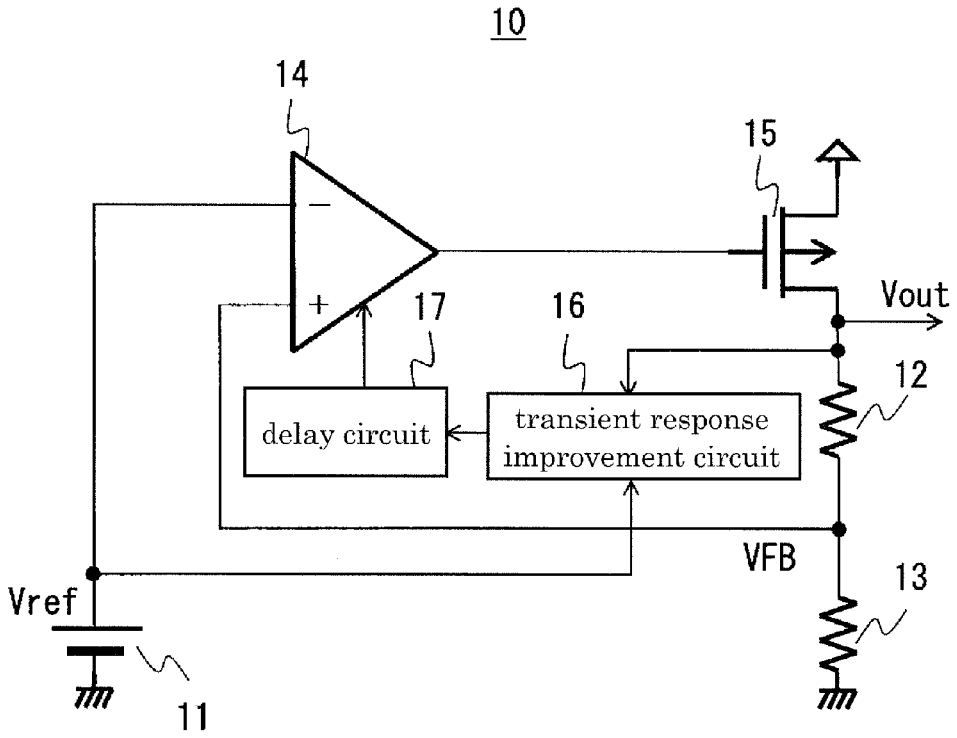
FIG. 1 is a circuit diagram of a voltage regulator according to an embodiment of the present invention.

FIG. 1 is a circuit diagram of a voltage regulator according to an embodiment of the present invention.

A voltage regulator 10 includes a reference voltage circuit 11, resistors 12 and 13 serving as feedback resistors, a voltage amplifier circuit 14, a PMOS transistor 15 serving as an output transistor, a transient response improvement circuit 16, and a delay circuit 17.

The reference voltage circuit 11 is configured to output a reference voltage Vref. From the resistor 12 and the resistor 13, a feedback voltage VFB obtained by dividing an output voltage Vout at an output terminal by the resistors is output. The voltage amplifier circuit 14 is configured to control the PMOS transistor 15 based on a result of comparison between the reference voltage Vref and the feedback voltage VFB such that the output voltage Vout is constant. The transient response improvement circuit 16 is configured to receive the reference voltage Vref and the output voltage Vout as input to control an operating current of the voltage amplifier circuit 14.

Figure 2:
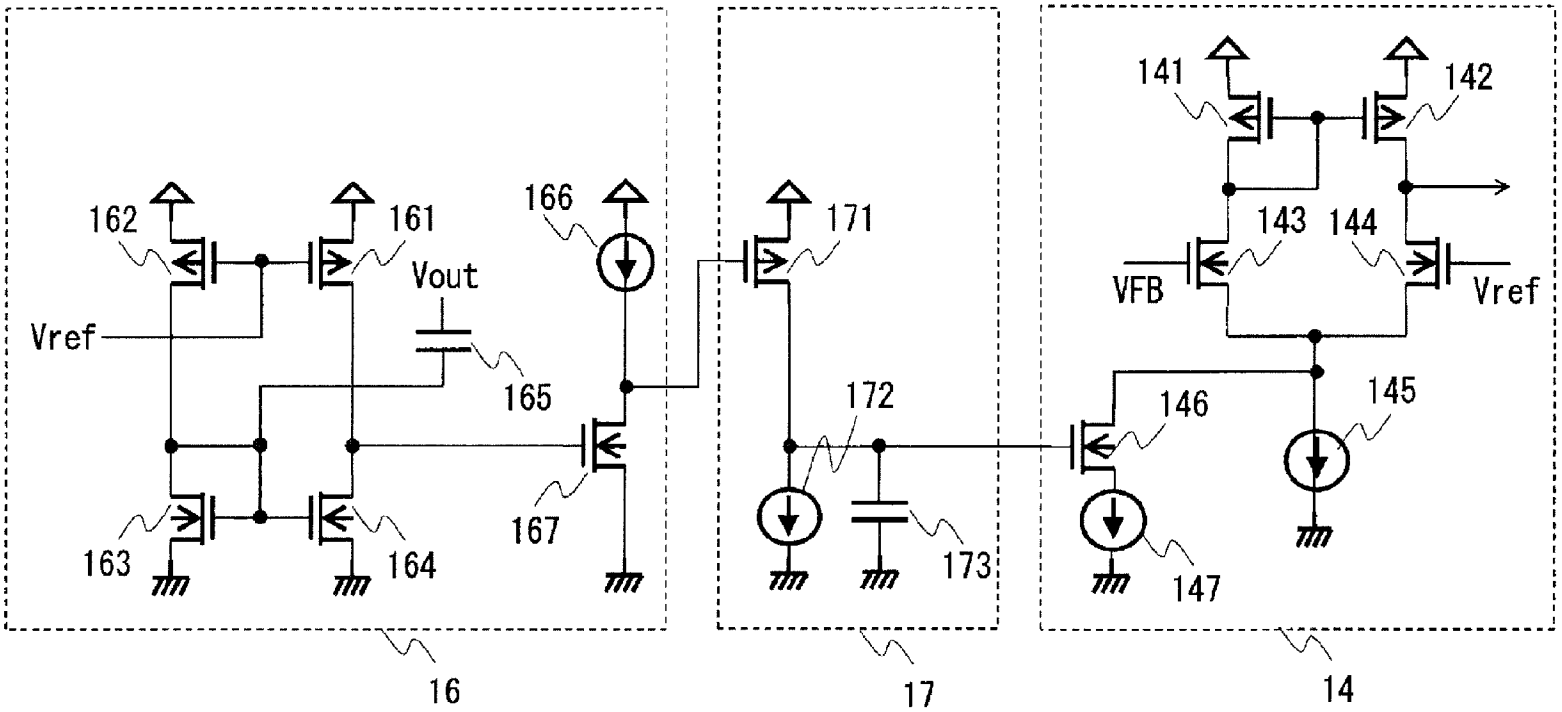
FIG. 2 is a circuit diagram for illustrating examples of a transient response improvement circuit, a delay circuit, and a voltage amplifier circuit of the voltage regulator according to this embodiment.
Figure 3:
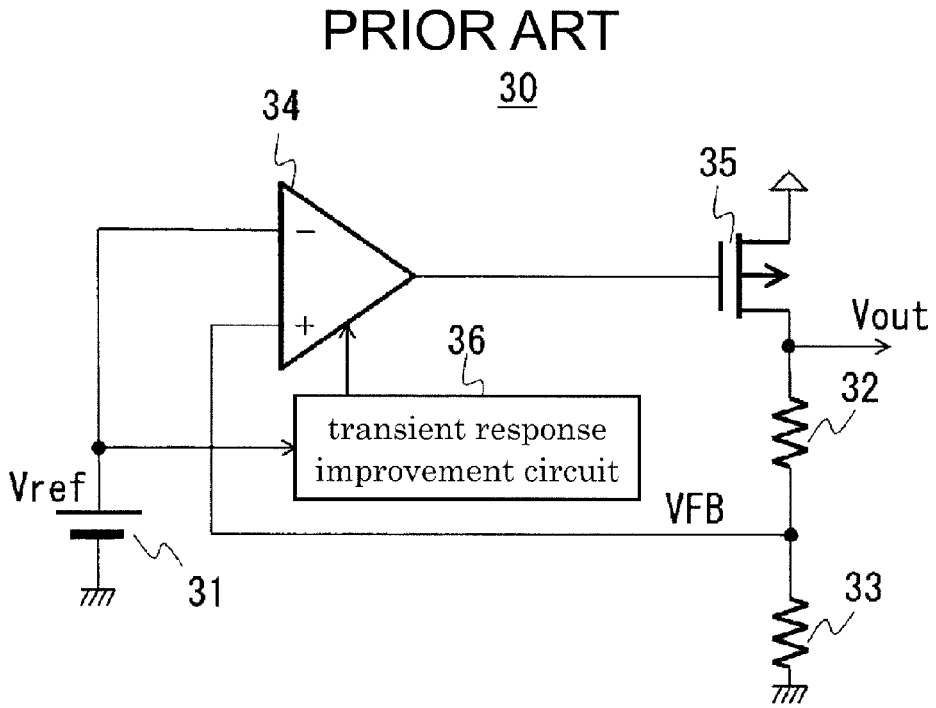
FIG. 3 is a circuit diagram of a related-art voltage regulator.
Figure 4:
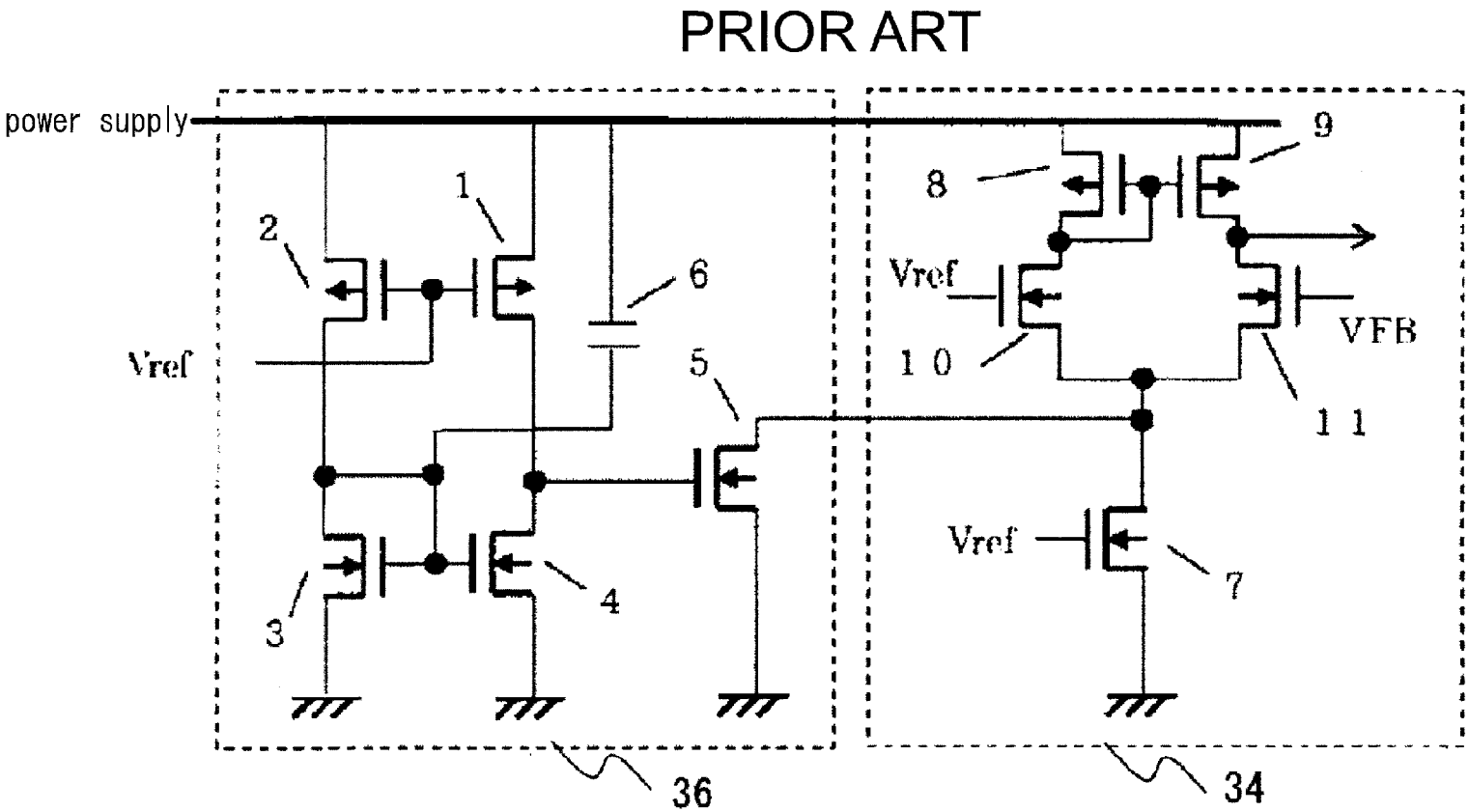
FIG. 4 is a circuit diagram of a transient response improvement circuit and a voltage amplifier circuit according to the related art.

FIG. 2 is a circuit diagram for illustrating examples of the transient response improvement circuit, the delay circuit, and the voltage amplifier circuit according to this embodiment.

The transient response improvement circuit 16 includes a detection portion configured to detect fluctuation in power supply voltage, and a constant current portion configured to supply a constant current to the detection portion.

The constant current portion includes a current mirror circuit including PMOS transistors 161 and 162. The PMOS transistors 161 and 162 are configured to cause a predetermined constant current to flow with the reference voltage Vref applied to gate electrodes thereof, to thereby supply the constant current to the detection portion.

The detection portion includes NMOS transistors 163 and 164 whose gate electrodes are connected to each other, a capacitor 165 connected to the gates of the NMOS transistors 163 and 164, for monitoring the output voltage Vout at the output terminal, and a first inverter including an NMOS transistor 167 and a constant current source 166. The detection portion is configured to detect fluctuation in output voltage Vout. A drain of the NMOS transistor 167 corresponds to an output terminal of the transient response improvement circuit 16.

The delay circuit 17 includes a second inverter including a PMOS transistor 171 and a constant current source 172, and a capacitor 173, and is configured to delay a signal that is output from the transient response improvement circuit 16.

The PMOS transistor 171 has a gate connected to the output terminal of the transient response improvement circuit 16, and a drain connected to the constant current source 172 and the capacitor 173. The drain of the PMOS transistor 171 corresponds to an output terminal of the delay circuit 17.

The voltage amplifier circuit 14 includes a differential amplifier portion including NMOS transistors 143 and 144 that are a differential pair of PMOS transistors 141 and 142 forming a current mirror circuit, and a constant current source 145 configured to supply an operating current to the differential amplifier portion. The voltage amplifier circuit 14 further includes an NMOS transistor 146 and a constant current source 147 for additionally supplying an operating current to the differential amplifier portion.

The NMOS transistor 146 and the constant current source 147 that are connected in series, and the constant current source 145 are connected in parallel to each other. The NMOS transistor 146 has a gate connected to the output terminal of the delay circuit 17.

Now, the operation of the voltage regulator 10 of this embodiment is described.

When the output voltage Vout at the output terminal does not fluctuate, the NMOS transistors 163 and 164 of the detection portion in the transient response improvement circuit 16 are on, and a constant current supplied from the constant current portion flows. A source of the NMOS transistor 164 is grounded, and hence a drain voltage of the NMOS transistor 164 at this time is lower than a threshold value of the NMOS transistor 167. Thus, the NMOS transistor 167 is off, and a voltage at the drain of the NMOS transistor 167, namely, a voltage at the output terminal of the transient response improvement circuit 16 is substantially the power supply voltage, due to the constant current source 166.

In the delay circuit 17, the PMOS transistor 171 is off, and hence the capacitor 173 is discharged by the constant current source 172. Consequently, the delay circuit 17 outputs a ground voltage.

Thus, the NMOS transistor 146 is off, and hence the voltage amplifier circuit 14 operates with an operating current supplied from the constant current source 145.

When the output voltage Vout at the output terminal fluctuates, in the capacitor 165 of the detection portion in the transient response improvement circuit 16, charges depending on an amount of fluctuation in output voltage Vout and gate voltages of the NMOS transistors 163 and 164 are accumulated.

When the output voltage Vout drops, the gate voltages of the NMOS transistors 163 and 164 also drop accordingly to the output voltage Vout. As the gate voltages of the NMOS transistors 163 and 164 decrease, the NMOS transistors 163 and 164 are turned off. As a consequence, a voltage at the drain of the NMOS transistor 164 is increased. Thus, the NMOS transistor 167 is turned on, and the voltage at the drain of the NMOS transistor 167, namely, the voltage at the output terminal of the transient response improvement circuit 16 becomes substantially the ground voltage.

In the delay circuit 17, the PMOS transistor 171 is turned on, and hence the capacitor 173 is charged. Consequently, the delay circuit 17 outputs the power supply voltage.

Thus, the NMOS transistor 146 is turned on, and hence the voltage amplifier circuit 14 operates with operating currents supplied from the constant current source 145 and the constant current source 147. That is, the operating current of the voltage amplifier circuit 14 is increased to improve the transient response thereof.

For example, when the NMOS transistor 164 is a transistor having a threshold voltage of 0.3 V, and the NMOS transistor 163 is a transistor having a threshold voltage of 0.5 V, gate potentials of the NMOS transistors 163 and 164 are 0.5 V or more. In this case, a fluctuation level of the output voltage Vout needs to be substantially 0.2 V in order to turn off the NMOS transistor 164. This is because there is no need to increase the operating current of the voltage amplifier circuit 14 when the fluctuation level of the output voltage Vout is small.

The threshold voltages of the NMOS transistors described above are examples, and the threshold voltages and the currents of the PMOS transistors 161 and 162 may be arbitrarily set depending on a detected level of the output voltage Vout.

In addition, according to this embodiment, delay time may be arbitrarily set through adjustment of the capacitance value of the capacitor 173, the current value of the constant current source 172, and the size of the PMOS transistor 171 in the delay circuit 17.

Further, the voltage regulator 10 of this embodiment has the configuration in which the operating current of the voltage amplifier circuit 14 is increased by the constant current source 147. As a consequence, the operating current is not excessively increased and the voltage amplifier circuit 14 can thus stably operate, even when the decreasing level of the output voltage is large, for example.

As described above, according to the voltage regulator of the present invention, the delay circuit 17 is provided between the transient response improvement circuit 16 and the voltage amplifier circuit 14, and hence the effect that the transient response characteristics of the voltage amplifier circuit 14 can be optimized is provided.

Although fluctuation in output voltage Vout is detected in the above description, it is apparent that a similar effect is obtained also when fluctuation in power supply voltage is detected.

What is claimed is:

1. A voltage regulator, comprising:

a voltage amplifier circuit configured to compare a feedback voltage depending on an output voltage of an output transistor and a reference voltage to each other to control the output transistor;

a transient response improvement circuit configured to detect fluctuation in the output voltage and comprising a capacitor coupled to an output terminal that outputs the output voltage; and a delay circuit connected to an output terminal of the transient response improvement circuit, wherein upon detection of fluctuation in the output voltage, the output terminal of the transient response improvement circuit becomes substantially a ground voltage and the delay circuit outputs a power supply voltage;

wherein an operating current of the voltage amplifier circuit is controlled depending on a signal that is output from the transient response improvement circuit.

* * * * *